US009185939B2

(12) United States Patent
Jarriault et al.

(10) Patent No.: US 9,185,939 B2
(45) Date of Patent: Nov. 17, 2015

(54) AEROSOL-GENERATING ARTICLE HAVING BIODEGRADEBLE FLAVOUR-GENERATING COMPONENT

(71) Applicant: Philip Morris Products S.A., Neuchatel (CH)

(72) Inventors: Marine Jarriault, Bern (CH); Alexis Louvet, Lausanne (CH); Cedric Meyer, Lausanne (CH); Daniele Sanna, Castel Maggiore-Bologna (IT); Gerard Zuber, Froideville (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/378,534

(22) PCT Filed: Dec. 28, 2012

(86) PCT No.: PCT/EP2012/077087
§ 371 (c)(1),
(2) Date: Aug. 13, 2014

(87) PCT Pub. No.: WO2013/120566
PCT Pub. Date: Aug. 22, 2013

(65) Prior Publication Data

US 2015/0027475 A1 Jan. 29, 2015

(30) Foreign Application Priority Data

Feb. 13, 2012 (EP) ..... 12155250

(51) Int. Cl.
*A24F 47/00* (2006.01)
*A24D 3/04* (2006.01)

(52) U.S. Cl.
CPC ..... *A24F 47/008* (2013.01); *A24D 3/04* (2013.01); *A24D 3/048* (2013.01); *A24F 47/006* (2013.01)

(58) Field of Classification Search
CPC ..... A24D 3/048; A24D 47/006; A24D 3/04
See application file for complete search history.

(56) References Cited

U.S. PATENT DOCUMENTS 4,281,671 A 8/1981 Bynre et al.
5,360,023 A * 11/1994 Blakley et al. ..... 131/331
(Continued)

FOREIGN PATENT DOCUMENTS

EP 2 020 158 A 11/1979
EP 1 889 550 A1 2/2008
(Continued)

OTHER PUBLICATIONS

U.S. Appl. No. 14/363,093, filed Jun. 5, 2014, Zuber et al.
(Continued)

*Primary Examiner* — Anthony Calandra
(74) *Attorney, Agent, or Firm* — Oblon, McClelland, Maier & Neustadt, L.L.P.

(57) ABSTRACT

An aerosol-generating article is provided, including a plurality of elements assembled in the form of a rod, the plurality of elements including an aerosol-forming substrate, and a mouthpiece filter located downstream from the aerosol-forming substrate within the rod. The aerosol-generating article further includes a volatile flavor-generating component disposed between the aerosol-forming substrate and the mouthpiece filter within the rod. In some embodiments, the volatile flavor-generating component is supported by a low resistance support element located between the aerosol-forming substrate and the mouthpiece filter. In some embodiments, the volatile flavor-generating component is menthol.

10 Claims, 2 Drawing Sheets

(56) References Cited

U.S. PATENT DOCUMENTS

| | | | | |
|---|---|---|---|---|
| 5,469,871 | A | 11/1995 | Barnes et al. | |
| 5,685,323 | A * | 11/1997 | Crooks et al. | 131/331 |
| 5,692,526 | A | 12/1997 | Adams et al. | |
| 5,819,751 | A | 10/1998 | Barnes et al. | |
| 2007/0235050 | A1 * | 10/2007 | Li et al. | 131/338 |
| 2008/0029114 | A1 | 2/2008 | Seitert et al. | |
| 2009/0301503 | A1 | 12/2009 | Peter et al. | |
| 2010/0059074 | A1 | 3/2010 | Brantley et al. | |
| 2010/0154809 | A1 | 6/2010 | Seitert et al. | |
| 2011/0036367 | A1 | 2/2011 | Saito et al. | |
| 2012/0048286 | A1 * | 3/2012 | Luan et al. | 131/344 |
| 2013/0019886 | A1 | 1/2013 | White et al. | |
| 2015/0027474 | A1 * | 1/2015 | Zuber et al. | 131/329 |

FOREIGN PATENT DOCUMENTS

| | | | |
|---|---|---|---|
| EP | 2 289 357 | A1 | 3/2011 |
| WO | WO 2009/143338 | A2 | 11/2009 |
| WO | WO 2010/028354 | A1 | 3/2010 |

OTHER PUBLICATIONS

International Search Report issued Oct. 8, 2013, in PCT/EP12/077087 filed Dec. 28, 2012.

Written Opinion of the International Searching Authority issued Oct. 8, 2013, in PCT/EP12/077087 filed Dec. 28, 2012.

International Preliminary Report on Patentability (IPRP) issued in PCT/EP2012/077087 on Oct. 29, 2014 (15 pages).

* cited by examiner

AEROSOL-GENERATING ARTICLE HAVING BIODEGRADEBLE FLAVOUR-GENERATING COMPONENT

CROSS REFERENCE TO RELATED APPLICATION

This application is a national phase application based on PCT/EP2012/077087, filed on Dec. 28, 2012.

The present specification relates to an aerosol-generating article comprising an aerosol-forming substrate and a biodegradable flavour-generating component for imparting a flavour to an aerosol inhaled by a consumer.

Articles in which an aerosol-forming substrate, such as a tobacco containing substrate, is heated rather than combusted are known in the art. Such articles may be termed aerosol-generating articles. The aim of such heated aerosol-generating articles is to reduce known harmful smoke constituents produced by the combustion and pyrolytic degradation of tobacco in conventional cigarettes. Typically in such heated aerosol-generating articles, an inhalable aerosol is generated by the transfer of heat from a heat source to an aerosol-forming substrate or material, which may be located within, around or downstream of the heat source. During consumption of the aerosol-generating article, volatile compounds are released from the aerosol-forming substrate by heat transfer from the heat source and entrained in air drawn through the article. As the released compounds cool, they condense to form an aerosol that is inhaled by the consumer.

Conventional cigarettes heat tobacco to a temperature that releases volatile compounds, by combustion of the tobacco itself. A consumer of a conventional cigarette inhales the smoke produced by combustion of tobacco, and any aerosol associated with the smoke. To modify the flavour of the mainstream smoke or aerosol, it is known to provide cigarettes with single and multi-segment mouthpiece filters that include flavourants, such as menthol. Menthol may be incorporated in the filter, wrapped tobacco rod or aerosol-generating substrate of cigarettes in liquid form using a suitable liquid carrier. Liquid forms of menthol are volatile and therefore tend to migrate or evaporate from during storage and flavour the tobacco in the cigarette. Alternatively, the menthol or other flavorant may be provided as a strip, a bead, or other means.

During consumption of a conventional cigarette, a line of combustion passes along the cigarette. Menthol that has migrated to the tobacco is released as the line of combustion passes. By contrast, heated aerosol-generating articles typically function by distillation of volatile compounds from an aerosol-forming substrate. Much of the substrate is heated at the same time and the volatile compounds are evolved. As flavour additives such as menthol are highly volatile, these tend to be evolved and consumed earlier than other elements in the substrate. Unless the menthol or flavour loading in the article is high, the flavour diminishes rapidly as the article is consumed.

EP1889550 discloses a multi-component filter providing flavour enhancement. The filter preferably has a length of between 24 mm and 48 mm and comprises a plug of cellulose acettate tow having a central cotton thread loaded with liquid flavourant.

While it is well known to mentholate a conventional cigarette, the application of a menthol flavour, or other flavour, to an aerosol-generating article may not be as straightforward. Filters that are typically used on aerosol-generating articles are shorter than filters used on conventional cigarettes. In addition, the amount of tobacco in aerosol generating articles is less than in a conventional cigarette. This may lower the maximum loading of menthol that is possible in the filter compared with a conventional cigarette.

The aerosol-forming substrate in an aerosol-generating article is typically a processed substrate that contains an aerosol former such as glycerine. For example, the aerosol-forming substrate included in an aerosol generating article and consumed in an aerosol generating device may comprise a crimped or folded tobacco plug comprised of cast leaf or reconstituted tobacco. A flavour, such as menthol, may be loaded into the aerosol-forming substrate. However, the structure of the aerosol-forming substrate may be compromised as a result. For example, the loading of menthol into a cast tobacco may lower the density and strength of cast leaf tobacco, making it less suitable for use as an aerosol-forming substrate in an aerosol-generating article.

It would be desirable to improve the addition of flavourings to aerosol-generating articles to improve the strength and consistency of the flavouring that may be added to such articles.

In one aspect an aerosol-generating article is provided comprising a plurality of elements assembled in the form of a rod. The plurality of elements includes an aerosol-forming substrate, and a mouthpiece filter located downstream from the aerosol-forming substrate within the rod. The aerosol-generating article comprises a volatile flavour-generating component disposed between the aerosol-forming substrate and the mouthpiece filter within the rod.

As used herein, aerosol-generating article is any article that generates an inhalable aerosol when an aerosol-forming substrate is heated. The term includes articles that comprise an aerosol-forming substrate that is heated by and external heat source, such as an electric heating element. An aerosol-generating article may be a non-combustible aerosol-generating article, which is an article that releases volatile compounds without the combustion of the aerosol-forming substrate. An aerosol-generating article may be a heated aerosol-generating article, which is an aerosol-generating article comprising an aerosol-forming substrate that is intended to be heated rather than combusted in order to release volatile compounds that can form an aerosol. The term includes articles that comprise an aerosol forming substrate and an integral heat source, for example a combustible heat source.

An aerosol-generating article may be a smoking article that generates an aerosol that is directly inhalable into a user's lungs through the user's mouth. An aerosol-generating article may resemble a conventional smoking article, such as a cigarette and may comprise tobacco. An aerosol-generating article may be disposable. An aerosol-generating article may alternatively be partially-reusable and comprise a replenishable or replaceable aerosol-forming substrate.

As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

An aerosol-forming substrate may comprise nicotine. An aerosol-forming substrate may comprise tobacco, for example may comprise a tobacco-containing material containing volatile tobacco flavour compounds, which are released from the aerosol-forming substrate upon heating. In preferred embodiments an aerosol-forming substrate may comprise homogenised tobacco material, for example cast leaf tobacco.

As used herein, an 'aerosol-generating device' relates to a device that interacts with an aerosol-forming substrate to generate an aerosol. The aerosol-forming substrate forms part of an aerosol-generating article, for example part of a smoking article. An aerosol-generating device may comprise one or more components used to supply energy from a power supply to an aerosol-forming substrate to generate an aerosol.

An aerosol-generating device may be described as a heated aerosol-generating device, which is an aerosol-generating device comprising a heater. The heater is preferably used to heat an aerosol-forming substrate of an aerosol-generating article to generate an aerosol.

An aerosol-generating device may be an electrically heated aerosol-generating device, which is an aerosol-generating device comprising a heater that is operated by electrical power to heat an aerosol-forming substrate of an aerosol-generating article to generate an aerosol. An aerosol-generating device may be a gas-heated aerosol-generating device. An aerosol-generating device may be a smoking device that interacts with an aerosol-forming substrate of an aerosol-generating article to generate an aerosol that is directly inhalable into a user's lungs thorough the user's mouth.

In preferred embodiments the aerosol-generating article may be substantially cylindrical in shape. The aerosol-generating article may be substantially elongate. The aerosol-generating article may have a length and a circumference substantially perpendicular to the length. The aerosol-generating article may have a total length between approximately 30 mm and approximately 100 mm. The aerosol-generating article may have an external diameter between approximately 5 mm and approximately 12 mm.

The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghettis, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In one embodiment, the aerosol-generating article has a total length of approximately 45 mm. The aerosol-generating article may have an external diameter of approximately 7 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm.

The mouthpiece filter is located at the downstream end of the smoking article. The filter may be a cellulose acetate filter plug. The filter may be approximately 7 mm in length in one embodiment, but may have a length of between approximately 5 mm and approximately 10 mm. The aerosol-generating article may comprise a spacer element located downstream of the aerosol-forming substrate.

As used herein, a volatile flavour-generating component is any volatile component that is added to an aerosol-generating article in order to provide a flavour. The volatile flavour-generating component may be in the form of a liquid or a solid. The volatile flavour-generating compound may be coupled to, or otherwise associated with, a support element. The volatile flavour-generating component may be menthol or contain menthol.

As used herein, the term 'menthol' denotes the compound 2-isopropyl-5-methylcyclohexanol in any of its isomeric forms. Menthol may be used in solid or liquid form. In solid form menthol may be provided as particles or granules. The term 'solid menthol particles' may be used to describe any granular or particulate solid material comprising at least about 80% menthol by weight.

Preferably, 1.5 or more mg of the volatile flavour generating component is included in each aerosol-generating article.

As used herein, the term 'rod' is used to denote a generally cylindrical element of substantially circular, oval or elliptical cross-section.

As used herein, the term 'longitudinal direction' refers to a direction extending along, or parallel to, the cylindrical axis of a rod.

The terms "upstream" and "downstream" may be used to describe relative positions of elements or components of the aerosol-generating article. For simplicity, the terms "upstream" and "downstream" as used herein refer to a relative position along the rod of the aerosol-generating article with reference to the direction in which the aerosol is drawn through the rod.

The distance between an aerosol-forming substrate and a mouthpiece filter in a typical aerosol-generating article is typically greater than the length of the mouthpiece filter. This intermediate section of an aerosol-generating device typically comprises a high proportion of free space within which an aerosol may form, and in which a volatile flavouring may disperse. The amount of flavour-generating component that may be loaded into this section may advantageously be higher than can be loaded into the filter.

By disposing the flavour-generating component between the aerosol-forming substrate and the mouthpiece filter, the flavour-generating component may infiltrate both of these components to an equal extent, and the aerosol-forming substrate to a greater extend than would be the case if the flavour was located in the filter. The combination of a greater potential loading of flavouring within the article and a closer proximity to the aerosol-forming substrate may mean that the total amount of flavouring that infiltrates the aerosol-forming substrate is advantageously greater than would be the case if the menthol was loaded in the filter. Advantageously, the flavour may also infiltrate components of the article located between the aerosol-forming substrate and the mouthpiece filter.

During consumption, the flavour-generating component infiltrated into the aerosol-forming substrate may last longer due to a greater loading. Furthermore, the presence of a relatively high level of flavour-generating component within the rod and infiltrated into the mouthpiece filter may result in the flavour surviving at desirable levels until the user has completely consumed the article.

The volatile flavour-generating component may be coupled to a fibrous support element. The fibrous support element may be any suitable substrate or support for locating, holding, or retaining the flavour-generating component. The fibrous support element may be, for example, a paper support. Such a paper support may be saturated with a liquid component such as liquid menthol. The fibrous support may be, for example, a thread or twine. Such a thread or twine may be saturated in a liquid component such as liquid menthol. Alternatively, such a thread or twine may be threaded to or otherwise coupled to a solid flavour generating component. For example, solid particles of menthol may be coupled to a thread.

Preferably the plurality of elements are assembled within a wrapper to form the rod. Suitable wrappers are known to those skilled in the art. Preferably the volatile flavour-generating component is supported by an elongated fibrous support element, such as a thread or twine. Preferably, the volatile flavour-generating component is disposed radially inward from an inner surface of the wrapper within the rod, the fibrous support element having a longitudinal dimension disposed substantially parallel to a longitudinal axis of the rod. Where the intermediate section between the aerosol-forming substrate and the mouthpiece filter is enclosed within a wrapper, this section is effectively a cavity within which the flavour-generating component can be retained. For the flavour-generating component to pass out of the article it must either pass through the aerosol-forming substrate or through the mouthpiece filter. When passing through either of these elements some flavour is retained. Thus, the efficacy of a given amount of volatile flavour-generating component may be greater when the component is positioned between the aerosol-forming substrate and the mouthpiece filter within the article.

It may be advantageous for the aerosol-generating article to comprise a low resistance support element located upstream of the mouthpiece and downstream of the aerosol-forming element. The low resistance support element comprises at least one longitudinally extending channel for locating the volatile flavour-generating component within the rod. When consumed, a user draws air from the article by drawing on the mouthpiece filter. Aerosol generated within the article passes through the mouthpiece and is inhaled by the user. It is desirable that the passage of air and aerosol between the aerosol-forming substrate and the mouthpiece filter should not meet with a great resistance. In other words, it is desirable that there is a minimal pressure drop between the aerosol-forming substrate and the mouthpiece filter. Thus, a support element for the flavour-generating component may be termed a low resistance support element if it provides a low resistance to the passage of air along a longitudinal direction of the rod, which may be termed a low resistance to draw. Resistance to draw (RTD) is the pressure required to force air through the full length of the object under test at the rate of 17.5 ml/sec at 22° C. and 101 kPa (760 Torr). RTD is typically expressed in units of $mmH_2O$ and is measured in accordance with ISO 6565: 2011.

It may be advantageous for the volatile flavour-generating component to be coupled to an elongated fibrous support and for the elongated fibrous support to be located by a channel in a low resistance support element. It may be possible to form a low resistance support element containing the elongated fibrous support and then use the support element as a component element of the aerosol-generating article.

The low resistance support element may comprise a plurality of longitudinally extending channels. The low resistance support element may have a porosity of between 50% and 90% in the longitudinal direction.

The plurality of longitudinally extending channels in the low resistance support element may be formed by processing a sheet material. The processing may include one or more processes selected from the list consisting of crimping, pleating, gathering or folding to form the channels.

The plurality of longitudinally extending channels may be defined by a single sheet that has been crimped, pleated, gathered or folded to form multiple channels. Alternatively, the plurality of longitudinally extending channels may be defined by multiple sheets that have been crimped, pleated, gathered or folded to form multiple channels. The plurality of longitudinally extending channels may be defined by a single sheet that has been pleated, gathered or folded to form multiple channels. The sheet may also have been crimped.

As used herein, the term 'sheet' denotes a laminar element having a width and length substantially greater than the thickness thereof.

As used herein, the term 'longitudinal direction' refers to a direction extending along, or parallel to, the cylindrical axis of a rod.

As used herein, the term 'crimped' denotes a sheet having a plurality of substantially parallel ridges or corrugations. Preferably, when the aerosol-generating article has been assembled, the substantially parallel ridges or corrugations extend in a longitudinal direction with respect to the rod.

As used herein, the terms 'gathered', 'pleated', or 'folded' denote that a sheet of material is convoluted, folded, or otherwise compressed or constricted substantially transversely to the cylindrical axis of the rod. A sheet may be crimped prior to being gathered, pleated or folded. A sheet may be gathered, pleated or folded without prior crimping.

The low resistance support element may have a total surface area of between 300 $mm^2$ per mm length and 1000 $mm^2$ per mm length. The low resistance support element may function as a heat exchanger to cool aerosol generated within the article. The low resistance support element may alternatively be referred to as an aerosol cooling element.

It is preferred that airflow through the low resistance support element does not deviate to a substantive extent between adjacent channels. In other words, it is preferred that the airflow through the low resistance support element is in a longitudinal direction along a longitudinal channel, without substantive radial deviation. In some embodiments, the low resistance support element is formed from a material that has a low porosity, or substantially no-porosity other than the longitudinally extending channels. That is, the material used to define or form the longitudinally extending channels, for example a crimped and gathered sheet, has low porosity or substantially no porosity.

In some embodiments, the low resistance support element may comprise a sheet material selected from the group comprising a metallic foil, a polymeric sheet, and a substantially non-porous paper or cardboard. In some embodiments, the low resistance support element may comprise a sheet material selected from the group consisting of polyethylene (PE), polypropylene (PP), polyvinylchloride (PVC), polyethylene terephthalate (PET), polylactic acid (PLA), cellulose acetate (CA), starch based copolyester, and aluminium foil.

After consumption, aerosol-generating articles are typically disposed of. It may be advantageous for the elements forming the smoking article to be biodegradable. Thus, it may be advantageous for the aerosol-cooling element to be formed from a biodegradable material, for example a non-porous paper or a biodegradable polymer such as polylactic acid or a grade of Mater-Bi® (a commercially available family of starch based copolyesters). In some embodiments, the entire aerosol-generating article is biodegradable or compostable.

In some embodiments, the low resistance support element may be formed from a material having a thickness of between about 5 micrometers and about 500 micrometers, for example between about 10 micrometers and about 250 micrometers. In some embodiments, the low resistance support element has a total surface area of between about 300 square millimeters per millimeter of length ($mm^2/mm$) and about 1000 square millimeters per millimeter of length ($mm^2/mm$). In other words, for every millimeter of length in the longitudinal direction the low resistance support element has between about 300 square millimeters and about 1000 square millimeters of surface area. Preferably, the total surface area is about 500 $mm^2/mm$ per mm.

The low resistance support element may be formed from a material that has a specific surface area of between about 10 square millimeters per milligram ($mm^2/mg$) and about 100 square millimeters per milligram ($mm^2/mg$). In some embodiments, the specific surface area may be about 35 $mm^2/mg$.

Specific surface area can be determined by taking a material having a known width and thickness. For example, the material may be a PLA material having an average thickness of 50 micrometers with a variation of ±2 micrometers. Where the material also has a known width, for example, between about 200 millimeters and about 250 millimeters, the specific surface area and density can be calculated.

The low resistance support element may be directly coupled with or saturated with the flavour-generating component.

In some embodiments, phenolic compounds may be removed by interaction with the material forming the low resistance support element. For example, the phenolic compounds (for example phenols and cresols) may be adsorbed by the material that the low resistance support element is formed from.

As noted above, the low resistance support element may be formed from a sheet of suitable material that has been pleated, gathered or folded into an element that defines a plurality of longitudinally extending channels. A cross-sectional profile of such an element may show the channels as being randomly oriented. The low resistance support element may be formed by other means. For example, the low resistance support element may be formed from a bundle of longitudinally extending tubes. The low resistance support element may be formed by extrusion, molding, lamination, or injection of a suitable material.

The low resistance support element may comprise an outer tube or wrapper that contains or locates the longitudinally extending channels. For example, a pleated, gathered, or folded sheet material may be wrapped in a wrapper material, for example a plug wrapper, to form the aerosol-cooling element. In some embodiments, the low resistance support element comprises a sheet of crimped material that is gathered into a rod-shape and bound by a wrapper, for example a wrapper of filter paper. Preferably the volatile flavour-generating component is incorporated within the low resistance support element as it is formed. For example, a thread coupled to or saturated with a flavour-generating component may be deposited within a channel of the support element as the channel is formed.

In some embodiments, the low resistance support element is formed in the shape of a rod having a length of between about 7 millimeters (mm) and about 28 millimeters (mm). For example, a low resistance support element may have a length of about 18 mm. In some embodiments, the low resistance support element may have a substantially circular cross-section and a diameter of about 5 mm to about 10 mm. For example, a low resistance support element may have a diameter of about 7 mm.

Preferably the aerosol-generating article comprises a spacing element located upstream of the volatile flavour-generating component and downstream of the aerosol-forming substrate. The spacing element may help to locate the aerosol-forming substrate. The spacing element may be substantially tubular and may provide free space within which an aerosol is able to condense and within which a volatile flavour may permeate. The spacing element may be permeated with a flavour and contribute to the flavour experience of the user during consumption of the article.

In one aspect a low resistance support element may be provided. The low resistance support element comprises a volatile flavour-generating component and may be used as a component element of an aerosol-generating article. The low resistance support element may be any low resistance support element as described above in relation to the aerosol-generating article.

In one aspect a method of manufacturing a low resistance support element is provided. The method comprises the steps of; forming a sheet material into an element having plurality of longitudinally extending channels, in which the step of forming comprises one or more processes selected from the list consisting of crimping, pleating, gathering and folding the sheet material. The method then comprises the step of cutting the element to a desired length. A volatile flavour-generating component is incorporated within the support element during the forming. Preferably, an elongated fibrous support coupled to a volatile flavour-generating component is simultaneously deposited within one of the longitudinally extending channels during the step of forming the sheet material. The method may be any method described above in relation to the aerosol-generating article.

A specific embodiment will now be described with reference to the figures, in which.

Figure 1:
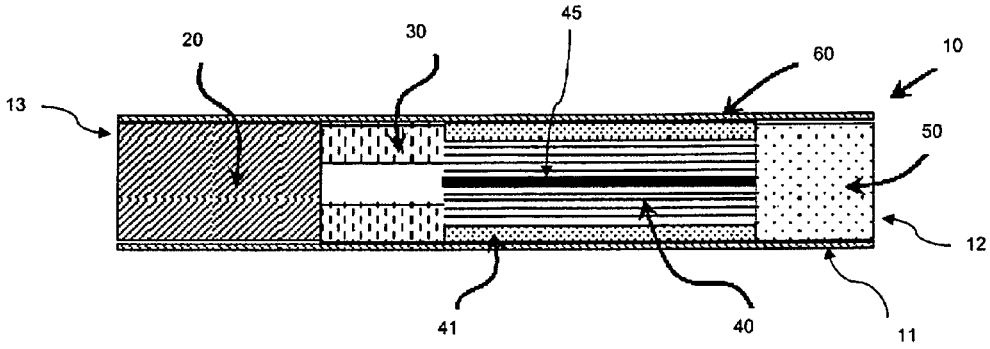
FIG. 1 is a schematic cross-sectional diagram of a first embodiment of an aerosol-generating article.

FIG. 1 illustrates an embodiment of an aerosol-generating article 10. The article 10 comprises four elements, an aerosol-forming substrate 20, a hollow cellulose acetate tube 30, a low resistance support element 40 supporting a mentholated thread 45, and a mouthpiece filter 50. These four elements are arranged sequentially and in coaxial alignment and are assembled by a cigarette paper 60 to form a rod 11. The rod 11 has a mouth-end 12, which a user inserts into his or her mouth during use, and a distal end 13 located at the opposite end of the rod 11 to the mouth end 12. Elements located between the mouth-end 12 and the distal end 13 can be described as being upstream of the mouth-end 12 or, alternatively, downstream of the distal end 13. The embodiment illustrated in FIG. 1 is particularly suitable for use with an aerosol-generating device comprising a heater for heating the aerosol-forming substrate.

When assembled, the rod 11 is about 45 millimeters in length and has an outer diameter of about 7.2 millimeters and an inner diameter of about 6.9 millimeters.

The aerosol-forming substrate 20 is located upstream of the hollow tube 30 and extends to the distal end 13 of the rod 11. The aerosol-forming substrate 20 comprises a bundle of crimped cast-leaf tobacco wrapped in a filter paper (not shown) to form a plug. The cast-leaf tobacco includes additives, including glycerine as an aerosol-forming additive.

The tube 30 is located immediately downstream of the aerosol-forming substrate 20 and is formed from cellulose acetate. One function of the tube 30 is to locate the aerosol-forming substrate 20 towards the distal end 13 of the rod 11 so that it can be contacted with a heating element. The hollow tube 30 acts to prevent the aerosol-forming substrate 20 from being forced along the rod 11 towards the low resistance support element 40 when a heating element is inserted into the aerosol-forming substrate 20. The hollow tube 30 also acts as a spacer element to space the low resistance support element 40 from the aerosol-forming substrate 20.

The low resistance support element 40 has a length of about 18 mm, an outer diameter of about 7.1 mm, and an inner diameter of about 6.9 mm. The aerosol-cooling element 40 is formed from a sheet of polylactic acid having a thickness of 50 μm±2 μm. The sheet of polylactic acid has been crimped and gathered to define a plurality of channels that extend along the length of the low resistance support element 40. To form the element, a sheet of polylactic acid is fed through crimping rollers to produce longitudinal crimps or corrugations. The crimped sheet is then gathered to form a cylinder having a plurality of longitudinally extending channels. During the formation of the support element 40, a mentholated thread 45 is deposited onto the crimped sheet parallel to the longitudinal crimps. Thus, the mentholated thread 45 is incorporated within a longitudinal channel of the support element 40 as it is formed. The menthol thread 45 will be loaded with a sufficient amount of menthol so as to provide a menthol load to element 40 of more than 1.5 mg.

The total surface area of the low resistance support element 40 is between 8000 $mm^2$ and 9000 $mm^2$, which is equivalent to approximately 500 $mm^2$ per mm length. The specific surface area of the low resistance support element 40 is approximately 2.5 $mm^2/mg$ and it has a porosity of between 60% and 90% in the longitudinal direction.

Porosity is defined herein as a measure of unfilled space in a rod including an aerosol-cooling element consistent with the one discussed herein. For example, if a diameter of the rod 11 was 50% unfilled by the element 40, the porosity would be 50%. Likewise, a rod would have a porosity of 100% if the inner diameter was completely unfilled and a porosity of 0% if completely filled. The porosity may be calculated using known methods.

Figure 3A:
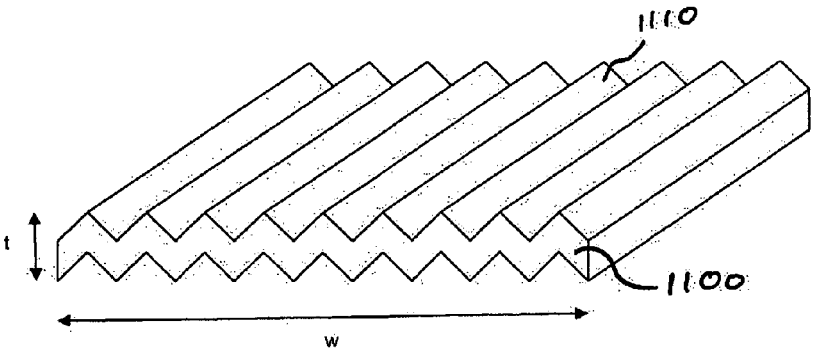
FIGS. 3A, 3B and 3C illustrate dimensions of a crimped sheet material and a rod that may be used to calculate the longitudinal porosity of the aerosol-cooling element.
Figure 3B:
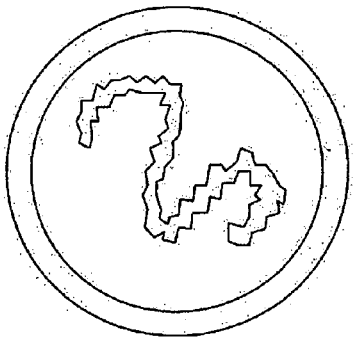
Figure 3C:
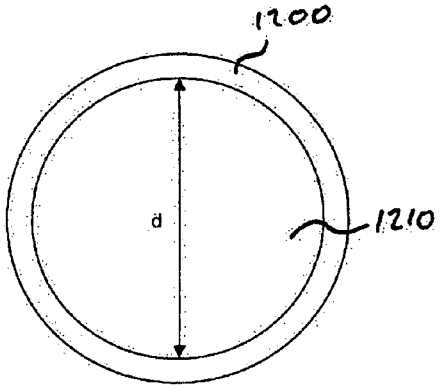

An exemplary illustration of how porosity is calculated is provided here and illustrated in FIGS. 3A, 3B, and 3C. When the low resistance support element is formed from a sheet of material 1110 having a thickness (t) and a width (w) the cross-sectional area presented by an edge 1100 of the sheet material 1110 is given by the width multiplied by the thickness. In a specific embodiment of a sheet material having a thickness of 50 micrometers (±2 micrometers) and width of 230 millimeters, the cross-sectional area is approximately $1.15\times10^{-5}$ $m^2$ (this may be denoted the first area). An exemplary crimped material is illustrated in FIG. 3A with the thickness and width labelled. An exemplary rod 1200 is also illustrated having a diameter (d). The inner area 1210 of the rod is given by the formula $(d/2)^2\pi$. Assuming an inner diameter of the rod that will eventually enclose the material is 6.9 mm, the area of unfilled space may be calculated as approximately $3.74\times10^{-5}$ $m^2$ (this may be denoted the second area). The higher the porosity in the longitudinal direction, the lower the resistance of the element.

The mouthpiece filter 50 is a conventional mouthpiece filter formed from cellulose acetate, and having a length of about 45 millimeters.

The four elements identified above are assembled by being tightly wrapped within a cigarette paper 60. The cigarette paper 60 in this specific embodiment is a conventional cigarette paper having standard properties. The interference between the cigarette paper 60 and each of the elements locates the elements and defines the rod 11 of the aerosol-generating article 10.

Although the specific embodiment described above and illustrated in FIG. 1 has four elements assembled in a cigarette paper, it is clear than an aerosol-generating article may have additional elements or fewer elements.

In storage after manufacture, a menthol vapour is evolved from the mentholated thread 45. This vapour is free to migrate within the aerosol-generating article 10. The menthol vapour infiltrates the aerosol-forming substrate 20. The menthol vapour also infiltrates the hollow tube 30 and the mouthpiece filter 50.

An aerosol-generating article 10 as illustrated in FIG. 1 is designed to engage with an aerosol-generating device (not shown) in order to be consumed. Such an aerosol-generating device includes means for heating the aerosol-forming substrate 20 to a sufficient temperature to form an aerosol. Typically, the aerosol-generating device may comprise a heating element that surrounds the aerosol-generating article 10 adjacent to the aerosol-forming substrate 20, or a heating element that is inserted into the aerosol-forming substrate 20.

Once engaged with an aerosol-generating device, a user draws on the mouth-end 12 of the smoking article 10 and the aerosol-forming substrate 20 is heated to a temperature of about 375 degrees Celsius. At this temperature, volatile compounds are evolved from the aerosol-forming substrate 20. These compounds, which include menthol flavouring, condense to form an aerosol. The aerosol is drawn through the rod 11 towards the user's mouth.

As the aerosol is drawn through the rod 11, menthol flavouring infused into the hollow tube 30, the mentholated thread 45 and the mouthpiece filter 50 is also entrained in the aerosol to provide a flavour experience for the consumer.

Figure 2:
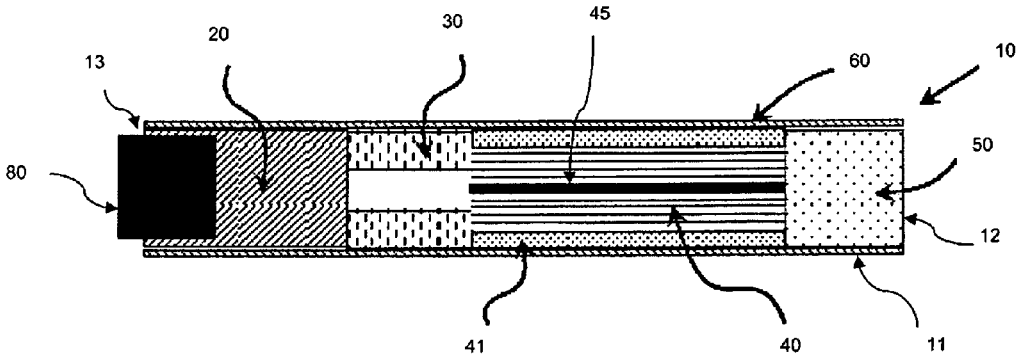
FIG. 2 is a schematic cross-sectional diagram of a second embodiment of an aerosol-generating article.

FIG. 2 illustrates a second embodiment of an aerosol-generating article. While the article of FIG. 1 is intended to be consumed in conjunction with an aerosol-generating device, the article of FIG. 2 comprises a combustible heat source 80 that may be ignited and transfer heat to the aerosol-forming substrate 20 to form an inhalable aerosol. The combustible heat source 80 is a charcoal element that is assembled in proximity to the aerosol-forming substrate at a distal end 13 of the rod 11. The article 10 of FIG. 2 is configured to allow air to flow into the rod 11 and circulate through the aerosol-forming substrate 20 before being inhaled by a user. Elements that are essentially the same as elements in FIG. 1 have been given the same numbering.

The exemplary embodiments described above are not limiting. In view of the above-discussed exemplary embodiments, other embodiments consistent with the above exemplary embodiment will now be apparent to one of ordinary skill in the art.

The invention claimed is:

1. A heated aerosol-generating article, comprising:

a plurality of elements assembled in the form of a rod having a total length of approximately 45 mm and an external diameter of approximately 7 mm, the plurality of elements including an aerosol-forming substrate having a length of approximately 10 mm, and a mouthpiece filter located downstream from the aerosol-forming substrate within the rod; and a volatile flavour-generating component disposed between the aerosol-forming substrate and the mouthpiece filter within the rod, the volatile flavour-generating component being coupled to a fibrous support element, and in which a low resistance support element is located upstream of the mouthpiece and downstream of the aerosol-forming substrate, the low resistance support element comprising a longitudinally extending channel locating the volatile flavour-generating component within the rod, and a plurality of longitudinally extending channels defined by a sheet material, and has been formed using one or more of the processes selected from the list consisting of crimping, pleating, gathering, and folding the sheet material to form the channels.

2. The article according to claim 1, in which the sheet material is a material selected from the list comprising polyethylene, polypropylene, polyvinylchloride, polyethylene terephthalate, polylactic acid, cellulose acetate, starch based copolyester, paper, and aluminium foil.

3. The article according to claim 1, in which the low resistance support element has a porosity of between 50% and 90% in the longitudinal direction.

4. The article according to claim 1, in which the low resistance support element has a total surface area of between about 300 $mm^2$ per mm length and about 1000 $mm^2$ per mm length.

5. The article according to claim 1, in which the low resistance support element has a total length of between about 7 mm and about 28 mm.

6. The article according to claim 1, in which the low resistance support element has a total length of about 18 mm.

7. The article according to claim 1, in which the sheet material has a thickness of between about 10 μm and about 250 μm.

8. The article according to claim 1, further comprising a separation element located upstream of the volatile flavour generating component and downstream of the aerosol-forming substrate.

9. The article according to claim 1, in which the volatile flavour generating component comprises menthol.

10. The article according to claim 1, further comprising more than 1.5 mg of menthol disposed between the mouthpiece filter and the aerosol-forming substrate.

* * * * *